United States Patent [19]

Sano et al.

[11] Patent Number: 4,878,444

[45] Date of Patent: Nov. 7, 1989

[54] ELECTRONIC SEWING MACHINE AND PRESSER FOOT PARTICULARLY FOR BUTTONHOLE STITCHES AND PROCESS FOR PRODUCING BUTTONHOLE STITCHES UTILIZING ALTERNATELY OPERABLE SENSOR

[76] Inventors: Yasuro Sano, 1601-2, Narahara-cho, Hachioji, Tokyo; Akio Koide, 1-11-4, Honda, Kokubunji, Tokyo; Toru Hyodo, Matsue-jutaku 4-209, 1923-1, Suwa-cho; Fumihiko Kobayashi, 1-26-14, Nakanokami-cho, both of Hachioji, Tokyo; Takayuki Kawasato, Room 303, 971-1, Nobe, Akikawa, Tokyo; Yasuhiko Osanai, 4-4-302, 1097, Tate-machi, Hachioji, Tokyo, all of Japan

[21] Appl. No.: 188,011

[22] Filed: Apr. 29, 1988

[30] Foreign Application Priority Data

| | | | |
|---|---|---|---|
| Apr. 30, 1987 | [JP] | Japan | 62-104698 |
| Apr. 30, 1987 | [JP] | Japan | 62-104699 |
| Apr. 30, 1987 | [JP] | Japan | 62-63989[U] |

[51] Int. Cl.[4] ..... D05B 3/06

[52] U.S. Cl. ..... 112/264.1; 112/447

[58] Field of Search ..... 112/447, 446, 264.1, 112/77, 235, 65

[56] References Cited

U.S. PATENT DOCUMENTS

| | | | |
|---|---|---|---|
| 4,181,087 | 1/1980 | Brauch et al. | 112/264.1 |
| 4,216,732 | 8/1980 | Marsh et al. | 112/447 |
| 4,232,617 | 11/1980 | Garron | 112/447 |
| 4,393,797 | 7/1983 | Marsh | 112/447 |
| 4,409,913 | 10/1983 | Adams et al. | 112/447 |

*Primary Examiner*—Peter Nerbun

*Attorney, Agent, or Firm*—Klein & Vibber

[57] ABSTRACT

An electronic zigzag sewing machine is provided with a presser foot including a switch lever pivotable between a first and second position. During buttonhole stitching operation the switch lever remains in the first position, but it is shifted to the second position when either one of longitudinal ends of a buttonhole is detected. A photo-sensor is mounted to the presser foot to output a detection signal when the switch lever is in the second position. A pattern number designating a specific stitch pattern of the buttonhole stitches is renewed to the next in response to the detection signal from the photo-sensor. A control system is provided to nullify operation of the photo-sensor during production of bar tacks of the buttonhole stitches so that the pattern number is not renewed in areas of the bar tacks irrespective of output of the detection signal.

11 Claims, 5 Drawing Sheets

ELECTRONIC SEWING MACHINE AND PRESSER FOOT PARTICULARLY FOR BUTTONHOLE STITCHES AND PROCESS FOR PRODUCING BUTTONHOLE STITCHES UTILIZING ALTERNATELY OPERABLE SENSOR

BACKGROUND OF THE INVENTION

Buttonhole stitches may be automatically produced with the prior art electronic sewing machines in response to buttonhole stitch control data stored in a memory unit mounted in the sewing machine. The buttonhole stitches include in general bar tacks for reinforcing opposite longitudinal ends of the buttonhole and first and second series of line tacks located at opposite sides of the buttonhole. The length or stitch number of the line tacks should be varied in correspondence with the size or diameter of the button concerned, and some solutions for this purpose have been proposed. For example, a limit section of a presser foot is connected via a lever to a microswitch mounted in a machine housing. The lever may be a hindrance to the operator during stitching operation. Before starting operation, the operator is required to set the lever as well as the presser foot. Another proposal is to mount a photo-sensor in the machine housing and to provide a presser foot with a member cooperating with the photo-sensor to detect the extreme ends of the buttonhole stitches. However, since the member is located far from the photo-sensor, the member would tend to be misoperated in response to ambient light. It has also been proposed to mount an electric contact on a presser foot for detecting the button size. The electric contact is not sufficiently protected by a cover and therefore may often be operated by static electricity, resulting in the possibility of destroying an electric control circuit.

After completing the buttonhole stitching operation for one buttonhole, it is often desired to repeat the same operation for the same buttonhole or in some other case to produce buttonhole stitches for another buttonhole located apart from the first buttonhole. In the latter case, the presser bar is raised to stop the sewing machine operation and the fabric is shifted to a position where the sewing machine needle is adapted to produce a first stitch of the buttonhole stitched for the second buttonhole. At this stand-by condition, nevertheless, the sewing machine is driven by stepping on a controller, which may be dangerous to the sewing machine operator.

When the buttonhole stitches are produced with the electronic sewing machine, it is necessary to renew a pattern number designating the bar tacks to the next pattern number for the line tacks, and vice versa, in response to signals generated at a time when an extreme end of the buttonhole is detected with sensor means. The bar tacks may be stitched by reciprocating the needle with little or no fabric feeding, which may cause the sensor means to output the signal to erroneously step-up the pattern number.

SUMMARY OF THE INVENTION

It is therefore an object of the invention to provide an electronic sewing machine capable of producing buttonhole stitches of a given length corresponding to a button size, while bringing no disadvantage or defect which may be encountered in the buttonhole stitching operation with the prior art sewing machine.

Another object of the invention is to provide a novel presser foot construction particularly adapted to produce buttonhole stitches, which may be used as a buttonhole sensor for detecting longitudinal ends of a buttonhole for which the buttonhole stitches are to be produced.

Still another object of the invention is to provide a buttonhole sensor having a simple construction and capable of detecting longitudinal ends of a buttonhole during buttonhole stitching operation with an electronic sewing machine.

Still another object of the invention is to provide an electronic sewing machine having a control system according to which the sewing machine operation is kept at standstill for safety purpose, while a presser bar is in a raised position after completing buttonhole stitching operation for one buttonhole, in which position a workpiece can be fed to another location for starting buttonhole stitching operation for another buttonhole.

Yet still another object of the invention is to provide an electronic sewing machine having a control system for renewing a pattern number to the next buttonhole stitch pattern only when a longitudinal end of a buttonhole is detected with sensor means, and preventing such pattern number renewing operation from being erroneously carried out in response to a detecting signal from the sensor means which might be outputted therefrom during bar tack portions near the longitudinal ends of the buttonhole stitches.

According to an aspect of the invention, there is provided a buttonhole presser foot used in combination with a zigzag sewing machine, comprising a presser bar mounted to a machine housing; a workpiece presser for exerting a downwardly directing pressure onto a workpiece to be stitched and adapted to be moved together with the workpiece; first and second engaging members located in opposition to each other on the workpiece presser, a distance between the first and second engaging members being adjustable in correspondence to a button size; a switch lever having a portion engageable with the first and second engaging members, the switch lever being adapted to be positioned in a first position in which the portion is located between the first and second engaging members with no contact thereto and a second position in which the portion is in engagement with either one of the first and second engaging members; and a sensor means for detecting the switch level being in the second position, thereby detecting a longitudinal end of the buttonhole.

According to another aspect of the invention, there is provided an electronic sewing machine comprising a controller for energizing the sewing machine; memory means for storing stitch control data for a plurality of stitch patterns including a buttonhole stitch pattern, each stitch pattern being assigned one or more pattern numbers; stitch pattern select means for selecting a specific one of the stitch patterns, thereby generating a corresponding pattern number or numbers; pattern producing means for producing a selected stitch pattern in response to the stitch control data stored in the memory means for the corresponding pattern number or numbers; and buttonhole sensor means for detecting longitudinal ends of a buttonhole to output a first signal when the buttonhole stitch pattern is being produced by the pattern producing means; the improvement which further comprises a counter operated in response to the first signal to output a step-up signal; pattern number renewing means operated in response to the step-up signal to renew the pattern number to the next of the selected stitch pattern; buttonhole stitch-over detecting means for stopping sewing machine operation and at the same time outputting a second signal when the buttonhole stitches have been completed; discriminating means for outputting a third signal when discriminating the sewing machine is not in operation; a safety means for setting the sewing machine to a safety condition in which the sewing machine operation is interrupted during receiving the first, second and third signals; and cancel means for cancelling the safety condition of the sewing machine.

According to still another aspect of the invention, there is provided an electronic sewing machine comprising memory means for storing stitch control data for a plurality of stitch patterns including a buttonhole stitch pattern, the stitch control data for the buttonhole stitch pattern including a number of different pattern data to be sequentially read out; stitch pattern select means for selecting a specific one of the stitch patterns; first control means operated in response to the stitch control data stored in the memory means of a stitch pattern selected by the stitch pattern select means to produce stitches of the selected stitch pattern; sensor means for detecting longitudinal ends of the buttonhole, the first control means being operated to renew the present pattern data to the next one when the sensor means detects one of the longitudinal ends of the buttonhole; and third control means for nullifying operation of the sensor means within bar tack stitch areas produced near the longitudinal ends of the buttonhole.

According to another aspect of the invention, there is provided a process for producing buttonhole stitches with an electronic sewing machine wherein plural series of stitch control data for the buttonhole stitches are sequentially read out from a memory unit to control a needle amplitude and a fabric feeding amount, one series of the stitch control data being renewed to the next series when a longitudinal end of the buttonhole is detected with sensor means, the improvement in which operation of the sensor means is annulled during stitching of portions of bar tacks produced at both longitudinal ends of the buttonhole.

BRIEF DESCRIPTION OF THE ACCOMPANYING DRAWINGS

These and other objects of the invention as well as characteristic features thereof will be fully understood from the following detailed description when read in conjunction with the accompanying drawings in which.

Figure 7:
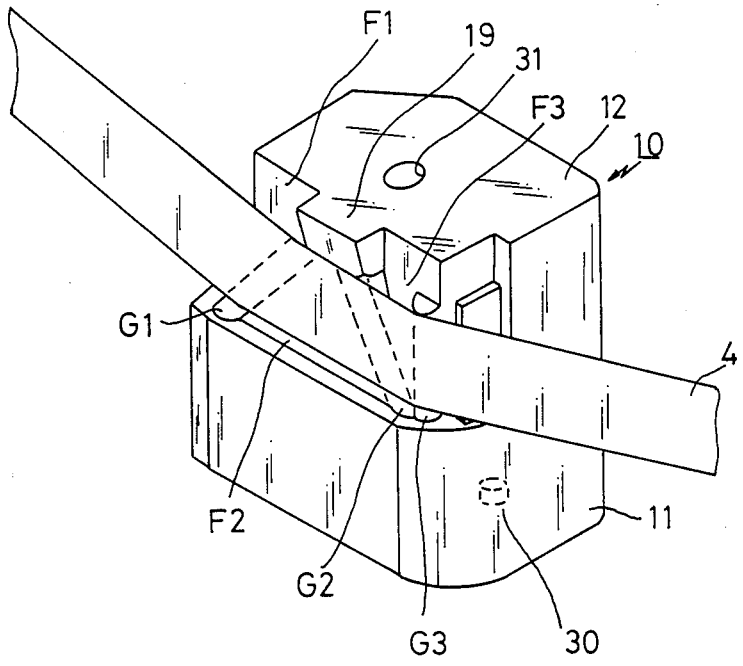
Figure 8:
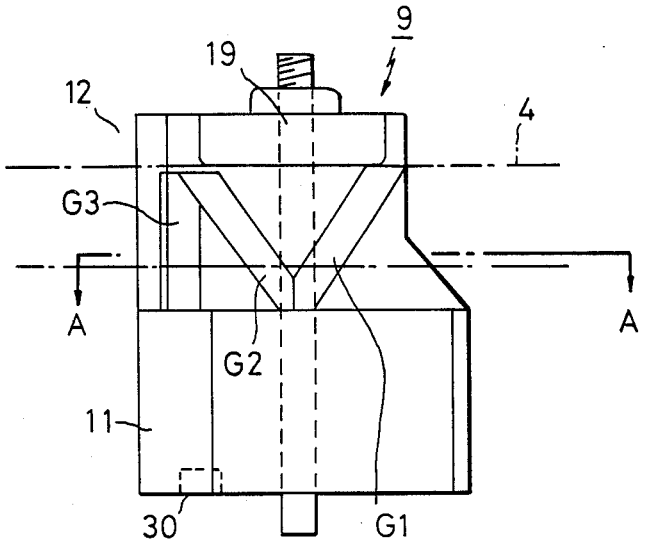
Figure 9:
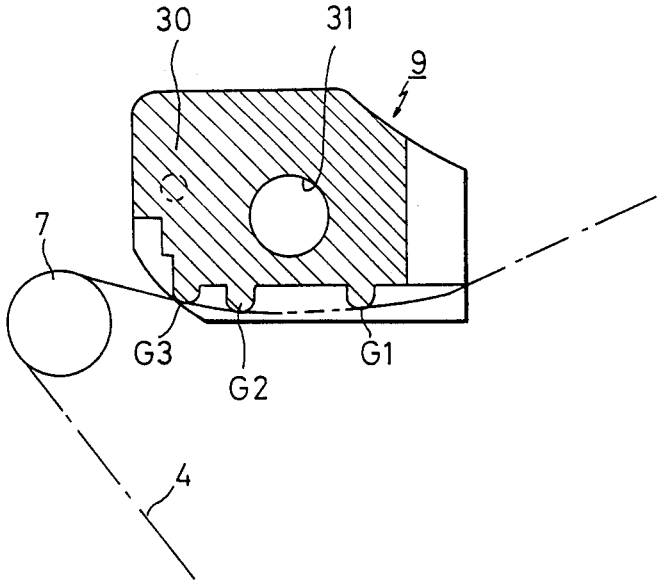
Figure 1:
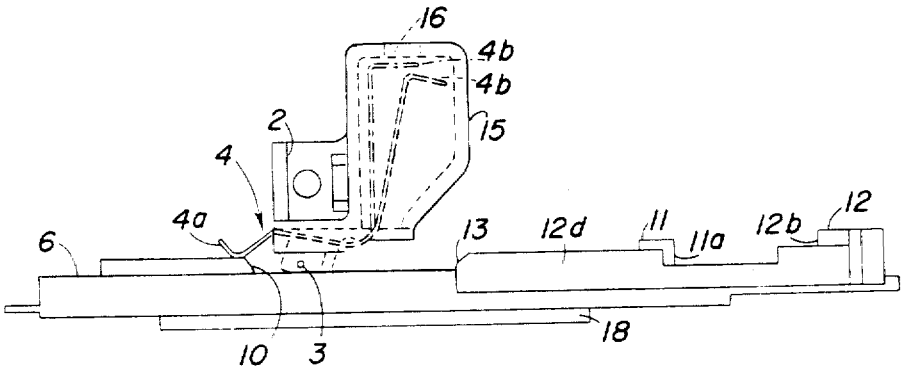
Figure 2:
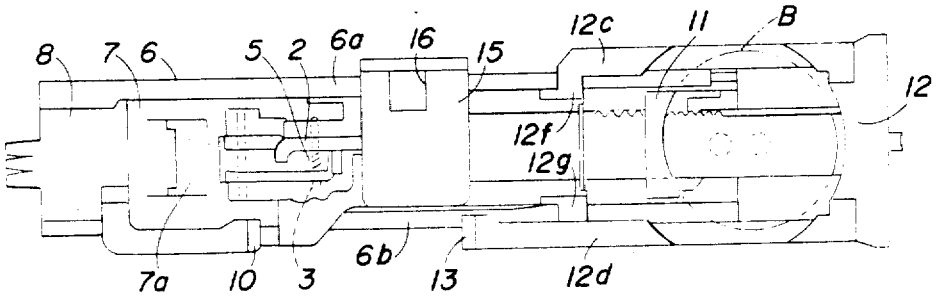
Figure 3:
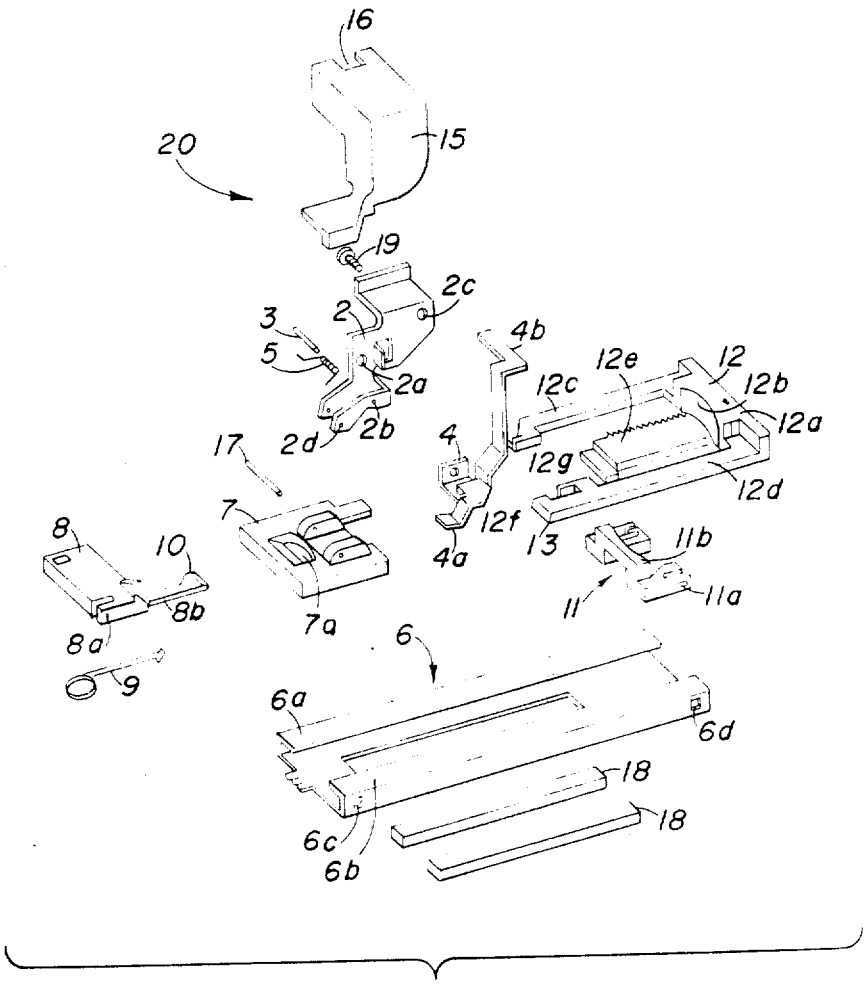
Figure 5:
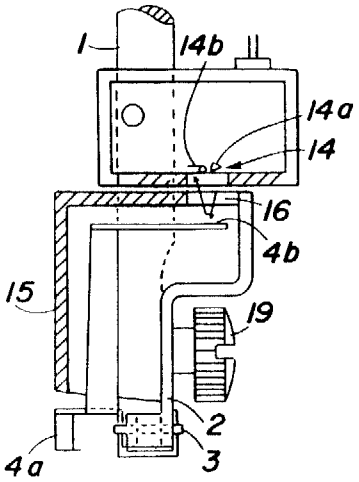
Figure 4:
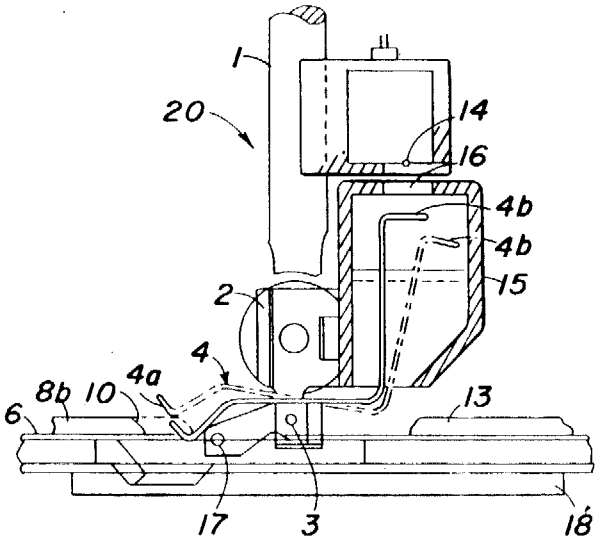
Figure 6:
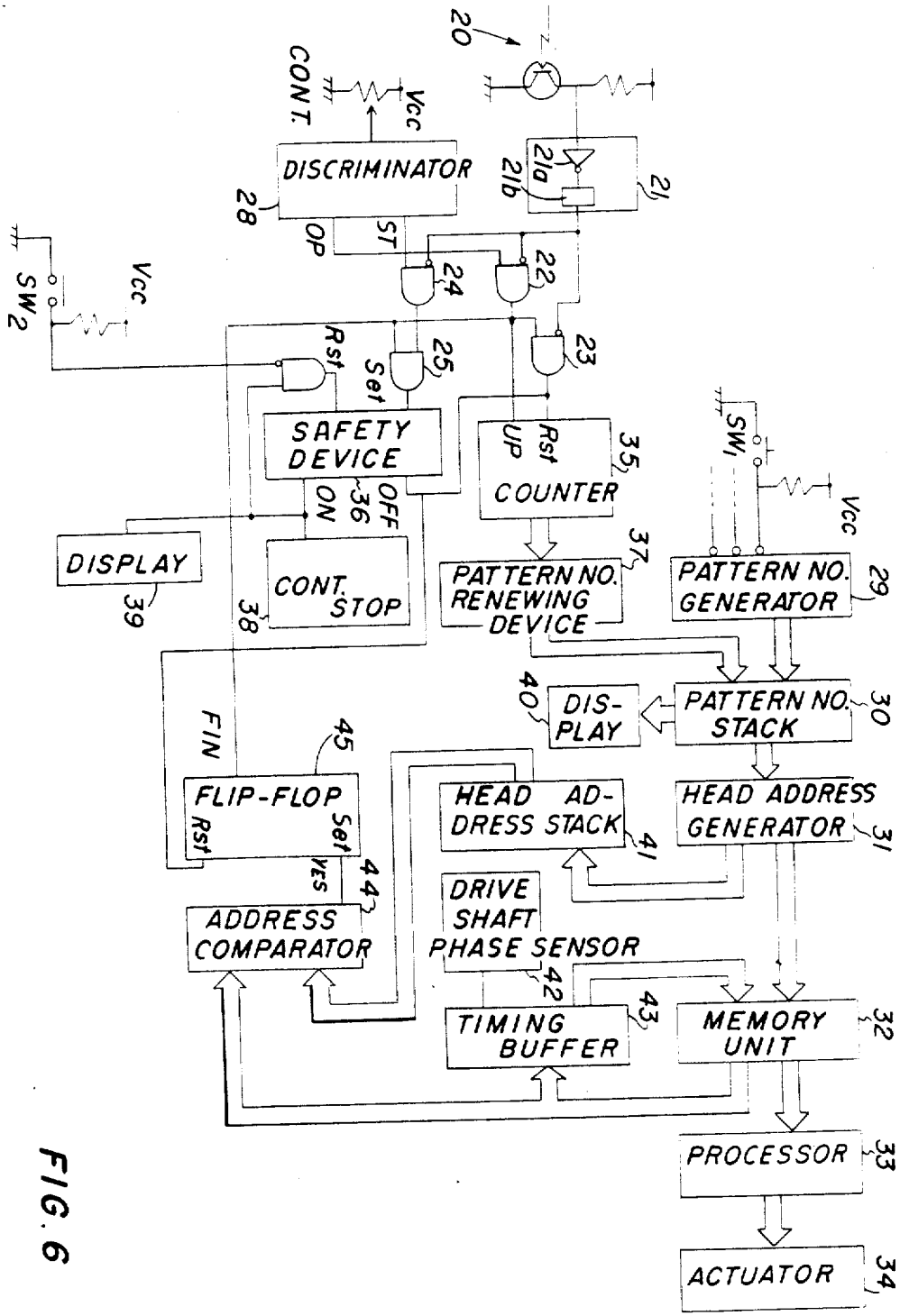
Figure 7A:
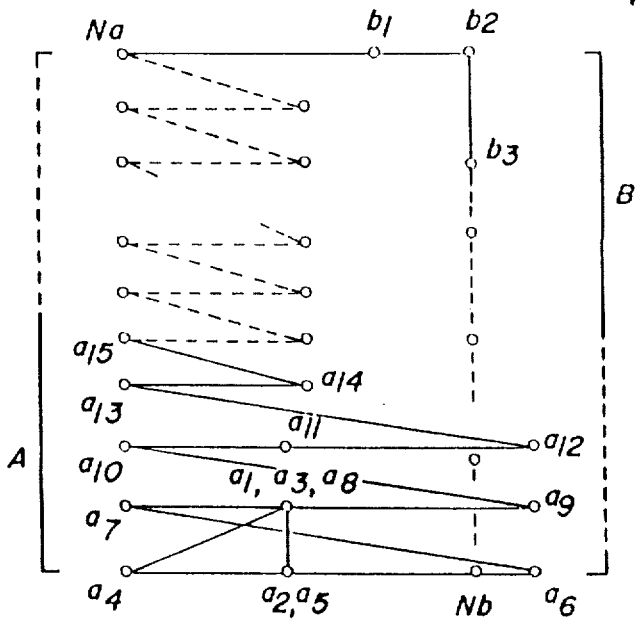
Figure 7B:
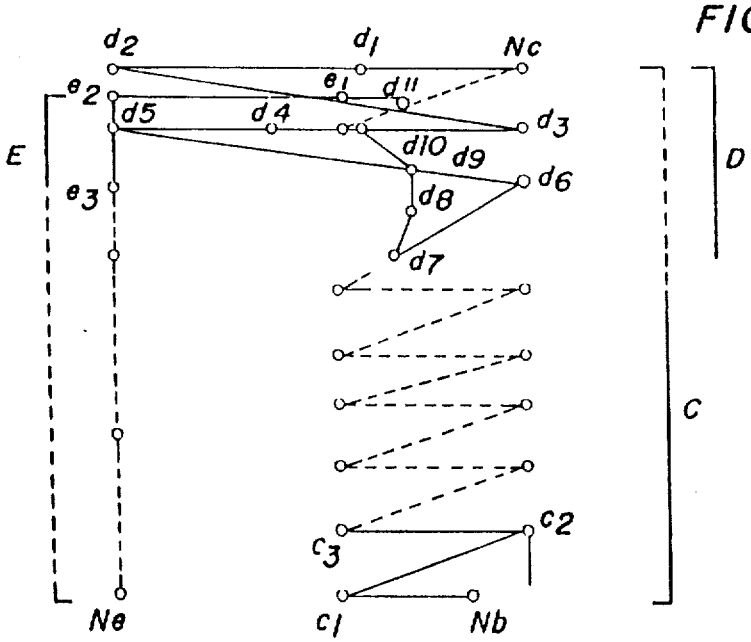
Figure 8:
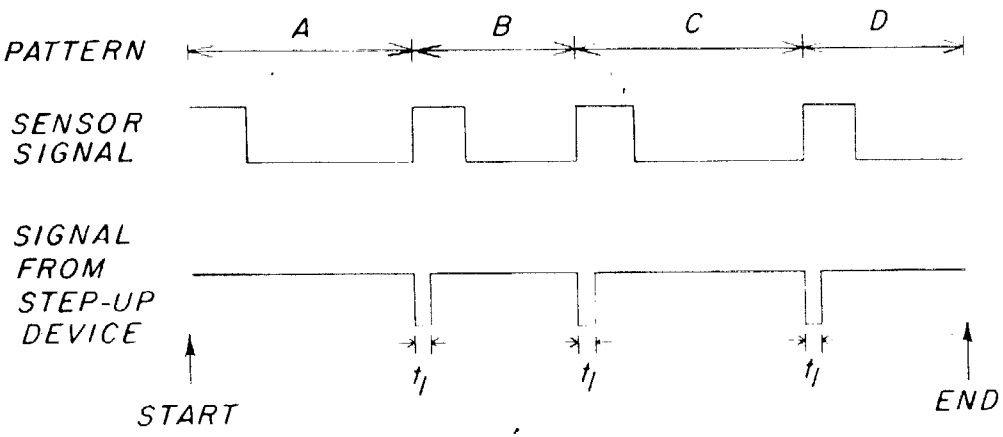
Figure 10:
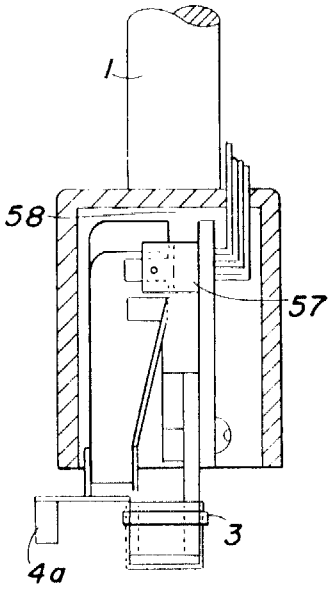
Figure 9:
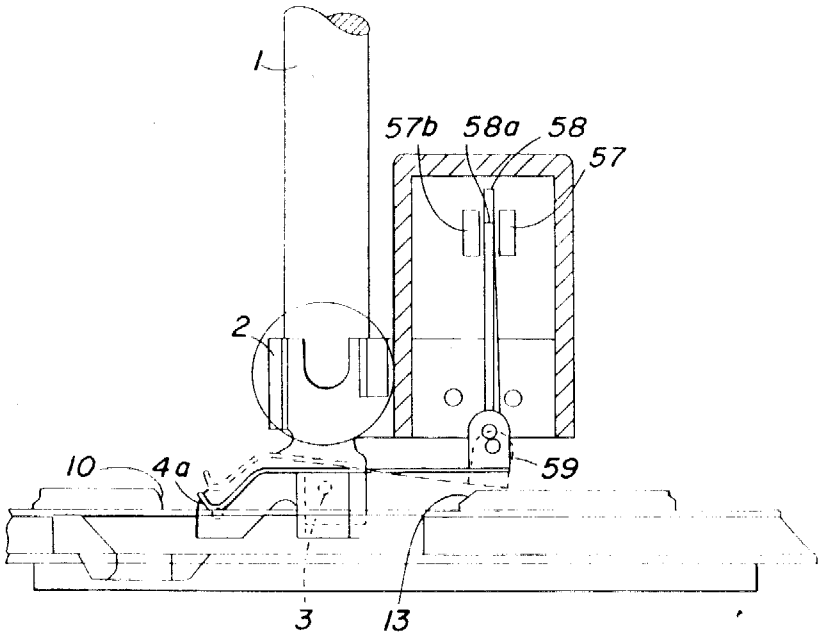

FIGS. 7(*a*) and 7(*b*) are explanatory views showing the manner in which buttonhole stitches are produced with the sewing machine provided with the presser foot;

FIG. 8 is a time chart illustrating the relation between signals outputted from a buttonhole sensor of the presser foot and a step-up device mounted in the sewing machine, respectively;

FIGS. 9 and 10 are side and front views showing a modified presser foot construction.

DESCRIPTION OF EMBODIMENTS

Referring specifically to FIGS. 1 through 5, a presser foot 20 embodying the invention includes a vertically extending presser bar 1 mounted on a sewing machine housing (not shown) for vertical reciprocating, and a support 2 secured to the presser bar 1 via a screw (not shown) extending through a hole 2*a*. A switch lever 4 having at its one end a dog-leg contact face 4*a* and at the other end a laterally extending arm 4*b* of a gloss reflector, is pivotably connected to the support frame 2 by means of a pivot pin 3 extending through a hole 2*b*. A spring 5 is wound around the pivot pin 3 to bias the switch lever 4 to normally rotate in the counter-clockwise direction as viewed in FIG. 4. The leading end of the support frame 2 is rotatably connected to a slider 7 by means of a pin 17 extending through a hole 2*d*. A needle dropping hole 7*a* is provided in the slider 7 to allow a sewing machine needle (not shown) to pass therethrough within a predetermined lateral swinging amplitude. The slider 7 is slideably held between opposing raised and inwardly directing walls 6*a* and 6*b* of a workpiece presser 6 to allow relative displacement between the slider 7 and the presser 6 in the normal feeding direction. A pair of press pads 18 of material such as rubber having a relatively great coefficient of friction are longitudinally attached to the underside of presser 6. Thus, presser 6 is moved together with a workpiece which is fed by a feed dog (not shown) along the normal feeding direction.

Adjacent to both ends of one raised wall section 6*a* of presser 6 are respectively formed apertures 6*c* and 6*d*. A block 8 is received between walls 6*a* and 6*b* at one end of presser 6 and secured thereat through engagement between aperture 6*c* and a projection 8*a* of block 8. Block 8 includes a rightward projecting arm 8*b* having a tapered face 10 at its leading end. A spring 9 is connected between block 8 and slider 7 to normally pull one toward another. On the contrary, a first button holer 11 is secured to presser 6 at the opposite end thereof through engagement between aperture 6*d* and projection 11*a*. A second button holder 12 includes a base section 12*a* with an inner arcuate wall 12*b*, a pair of extending arms 12*c* and 12*e*, and a central platform 12*e*. The leading end of arm 12*c* is inwardly bent to form a guide face 12*f* engageable with wall 6*a* of presser 6, while the other arm 12*d* has another guide face 12*g* opposed to face 12*f* and engageable with wall 6*b*. One side of platform 12*e* is notched to form saw-teeth which will be frictionally engageable with an inner face of first button holder 11. Through these engagements, second button holder 12 is slideably supported by presser 6. In the assembled condition, arms 12*c* and 12*d* extend in contact with the outer peripheries of raised wall sections 6*a* and 6*b* respectively, and platform 12*c* extends through a gate formed between first button holder 11 and the bottom of presser 6. The leading end of arm 12*d* is shaped into a tapered face 13 which is located in opposition to first tapered face 10. The arcuate inner wall 12*b* of second button holder 12 cooperates with another arcuate inner wall 11*b* of first button bolder 11 to accomodate therebetween a button of a given size or diameter. A distance between the opposing two tapered faces 10 and 13 is determined somewhat larger than a distance between the two arcuate walls 11*b* and 12*d*, which may be adjusted by sliding second button holder 12 with respect to the first holder 11 in correspondence with the diameter of the button held therebetween.

The switch lever 4 is housed in a cover 15 having at the upper face an opening 16. With cover 15 secured to support frame 2 by a fastening screw 19 extending through a hole 2*c*, the opening 16 is positioned just above the upper glass reflector 4*b* when switch lever 4 is biased by spring 5 to occupy its normal position. Above the cover is mounted a reflective photo-sensor 14 comprising a light emitting diode or the like element 14*a* emitting light downwardly through opening 16 toward gloss reflector 4*b* and a light receiving element 14*b* adapted to receive the reflection from gloss reflector 4*b*. To prevent ambient light from projecting toward gloss reflector 4*b* or light receiving element 14*b*, cover 15 and frame 2 are painted matte black.

Figure 1:
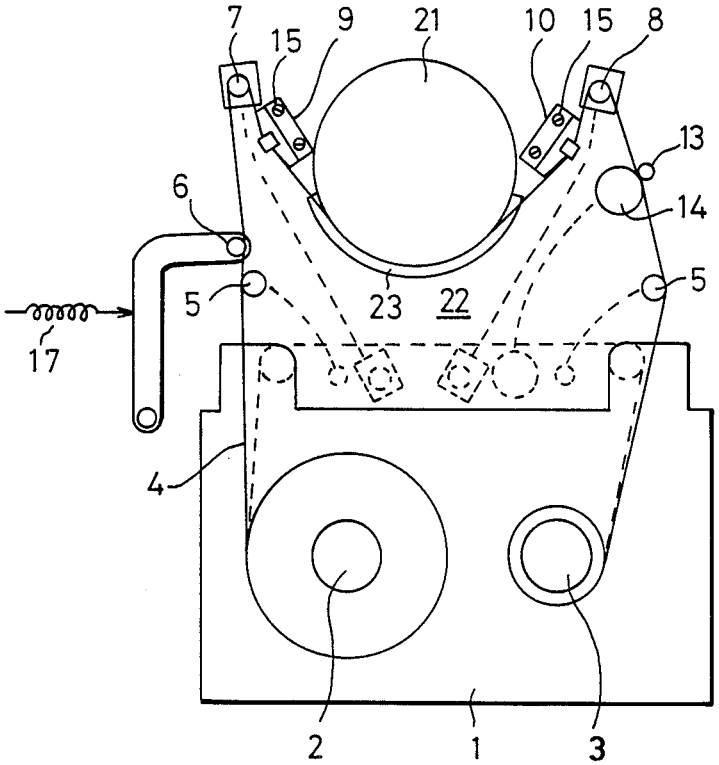
FIG. 1 is a side view showing a presser foot embodying the invention.
Figure 2:
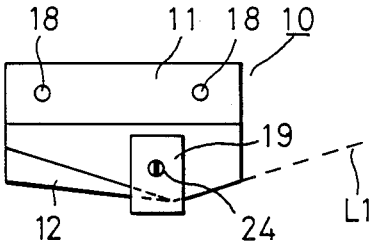
FIG. 2 is a plan view of the presser foot.
Figure 3:
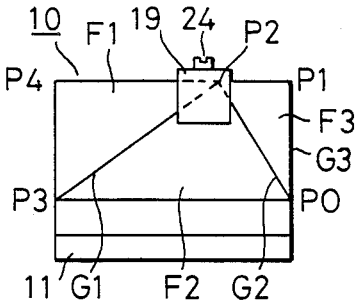
FIG. 3 is an exploded perspective view of the presser foot.
Figure 5:
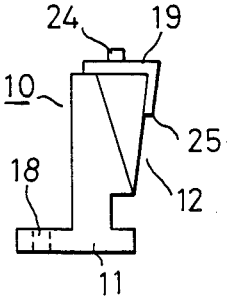
FIG. 5 is a front view corresponding to FIG. 4.
Figure 4:
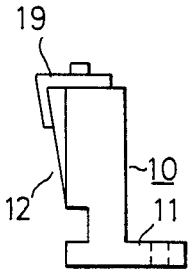
FIG. 4 is a side view, on an enlarged scale, partly in section, showing essential parts of the presser foot.
Figure 6:
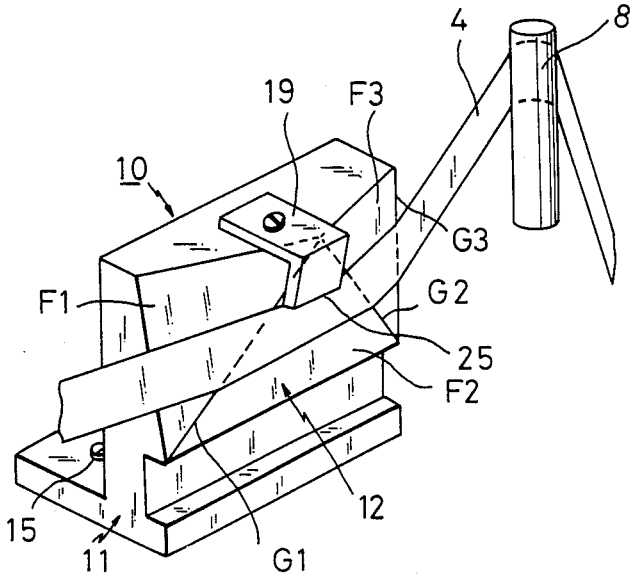
FIG. 6 is a block diagram showing a control system of an electronic sewing machine provided with the presser foot shown in FIGS. 1 through 5.

The presser foot 20 construced as above is used in combination with an electronic sewing machine having a control system shown in a block diagram of FIG. 6. When a buttonhole for a button B is to be stitched on the workpiece with the electronic sewing machine, the button B is actually placed on platform 12*e* of second button holder 12, while being in contact with the arcuate wall 11*b* of first button holder 11. Second button holder 12 is slid so that the arcuate wall 12*b* cooperates with the first arcuate wall 11*b* to hold in position button B therebetween. Thus, two tapered faces 10 and 13 are separated from each other, providing a distance therebetween which is automatically determined in correspondence to a size or diameter of button B and which is determinant of a length of the buttonhole to be stitched. Then, workpiece presser 6 is moved to the right so that the lower end 4*a* of switch lever 4 is caused to run aground on first tapered face 10. At this time, switch lever 4 is rotated in the clockwise direction against the biasing force of spring 5 to be positioned in its inoperative position shown in an imaginary line in FIG. 4 in which gloss reflector 4*b* is not able to reflect the light emitted from the diode 14*a* toward the receiving element 14*b*.

Then, a controller C is operated to start the sewing machine to drive. In response to manual operation of a button hole stitch key, a specific pattern number designating the first step of the buttonhole stitching operation is read out at a pattern number generator 29. The generator 29 thus sends the pattern number to a pattern number stack 30 where it is stacked. Meanwhile, the stack 30 sends a signal to a display 40 so that the stitch pattern to be produced in the first step of the buttonhole stitching operation is represented at the display 40.

The buttonhole stitch pattern is diagramatically illustrated in FIG. 7 by way of example. This buttonhole stitch pattern will be sequentially stitched in four steps. In the first step A, lower end bar tacks of a predetermined number of stitches for reinforcing one longitudinal end of the buttonhole, which are produced by successively dropping the needle at points $a_1$ to $a_{12}$, and then a first series of line tacks to be located at one (left) side of the buttonhole are produced from successive needle dropping points of $a_{13}$, $a_{14}$ and $a_{15}$ which ends at a point Na. The bar tacks are stitched with substantially the maximum needle amplitude but with substantially no fabric feeding amount, and the line tacks are stitched with substantially a half the maximum needle amplitude while the workpiece is fed in the backward direction by a given fabric feeding amount each stitch but one. A first pattern number of the buttonhole stitches is assigned to stitching of the part A. Definite stitch control data will be given to the points $a_1$ to $a_{15}$ and succeeding stitches be produced in response to stitch control data commanding that the similar line tacks be repeated with the same needle amplitude and with the same fabric feeding amount, until one longitudinal end of the buttonhole is detected with presser foot 20 described above, at point Na. The second part B will be stitched by designating a second pattern number of the buttonhole stitches. The second part B is produced starting at point Na and consists of lateral straight stitches made by points $b_1$ and $b_2$ and longitudinal straight stitches made by feeding the workpiece in the forward direction to drop the needle at points $b_3$ and succeeding points ending at point Nb, which can likewise be found by detecting the other longitudinal end of the buttonhole 20. Then the buttonhole stitching operation proceeds to the third step C in which a second series of line tacks at the other side of the buttonhole will be produced in the like manner as in the first series of line tacks. The third part C is produced by designating a third pattern number of the buttonhole stitches, which includes definite stitch control data for the stitches $c_1$ to $c_3$, succeeding stitches being produced by stitch control data commanding the repeated stitching operation of the line tacks. A finishing point Nc of the third part C can be found by the presser foot or sensor 20. The fourth part D includes a predetermined number of stitches comprising end stitches made by points $d_7$ to $d_{12}$, as well as upper end bar tacks to be produced in the like manner as in the lower end bar tacks. Each needle dropping point $d_1$ to $d_{12}$ constituting the fourth part D will be produced in accordance with definite stitch control data stored with respect to a fourth pattern number of the buttonhole stitches. The buttonhole stitches will thus be completed by successively producing the parts A to D. The buttonhole stitches further includes the fifth part E for returning the needle to a starting position ready to repeat the buttonhole stitching operation for the same buttonhole as from the step A. A fifth pattern number is assigned to the part E, including definite stitch control data for points $e_1$ to $e_3$. The starting position, namely a needle dropping point Ne may be found by the presser foot or sensor 20. Stitch control data for these steps are respectively stored in a memory unit 32 and sequentially read out by designating pattern numbers corresponding thereto step by step.

Again, the first stitch pattern number for the first part A comprising the lower end bar tacks and the first line tacks is stored in the stack 30, and the first stitch pattern A is represented at the display 40. Then, a head address of the buttonhole stitch pattern is generated at a head address generator 31 and supplied to a head address stack 41 and the memory unit 32, respectively. The head address is stached in the stack 41 for comparison with the next address, as described later.

The memory unit 32 is operated in response to the head address from the generator 11 to read out the stitch control data for a first stitch of the first pattern A. The stitch control data is then processed in a processor 13 so that the first stitch is produced by means of an actuator 14 which comprises in general an amplitude control stepping motor and a workpiece feed control stepping motor (both not shown), thereby controlling a needle amplitude and a fabric feeding amount for each stitch in accordance with the stitch control data.

Responsive to the head address designating signal, the memory unit 32 will also read out the next address. The next address is sent to a timing buffer 43 which cooperates with a drive shaft phase sensor 42 to generate a signal each time the sensor 42 detects a predetermined needle position in every one rotation of the sewing machine. The memory unit 32 reads out the next stitch control data and the next address each time receiving the signal from the timing buffer 43.

An address comparator 44 continuously receives the head address from the head address stack 41 and receives the next address from the memory unit 32 in each stitch. If the next address become coincident with the head address which means that the entire buttonhole stitching operation comprising the first to fourth steps A to D has been finished, the address comparator 44 causes a flip-flop 45 to set to automatically interrupt sewing machine operation and at the same time to output a signal. The signal is continuously outputted from the flip-flop 45 until it is reset responsive to a reset signal.

As above described, the presser foot 20 may be used as a buttonhole (BH) sensor for detecting the longitudinal ends of the buttonhole. When the first pattern A proceeds to the final stitch of the line tacks, at which time the contact face 4*a* is run aground on the second tapered face 13 so that the switch lever is turned to its inoperative position, the light emitted from the diode 14*a* is not reflected toward the other element 14*b*, thereby generating a high-level signal to a step-up device 21. The step-up device 21 comprises an inverter 21*a* and a one-shot multivibrator 21*b*. In response to the high-level signal supplied from BH sensor 20, the device 21 thus outputs a low-level signal for a predetermined short period of time ($t_1$) as shown in a timing chart of FIG. 8. A discriminator 28 cooperates with a controller CONT to discriminate whether the sewing machine is in operation or not. Of course an operation signal OP is being generated from the discriminator 28, AND gate 22 outputs a high-level signal to UP input terminal of a pattern number counter 35. Thus, the counter 35 outputs a count-up signal to a pattern number renewing device 37 where the next (second) pattern number for the second stitch pattern B is produced. The second pattern number is then stored in the stack 30. Consequently, the second pattern of straight stitches may be produced. Similarly, the third and fourth steps C and D may proceed successively to complete the buttonhole stitches.

When the entire buttonhole stitching operation in the steps A to D has been completed in the manner described above, the address supplied as the next address from the memory unit 32 will become coincident with the head address. The address comparator 44 therefore outputs a YES signal to a set input of the flip-flop 45, whereby the sewing machine is forced to stop and at the same time a finish signal FIN is outputted from the flip-flop 45. This FIN signal is sent directly to UP input of the counter 35 from which a count-up signal is thus outputted to the pattern number renewing device 37, and the next pattern number for the returning stitches of the part E is stored in the stack 10.

Further operation will be dependent upon whether it is desired to repeat the same buttonhole stitching operation for the same buttonhole. Where it is desired to repeat the buttonhole stitching operation, the controller CONT is now stepped on to start the stitching operation for the part E. When the needle is returned to the starting position Ne, BH sensor 20 detects the end of the buttonhole so that a one-shot low-level signal is generated from the step-up device 21 and supplied to the low-active input terminal of AND gate 23. At this time FIN signal is still being outputted from the flip-flop 45. Thus, AND gate 23 outputs a signal to a reset (Rst) input terminal of the counter 35 so that the first pattern number for the part A is reset to thereby repeat the buttonhole stitching operation in the like manner. Though the FIN signal from the flip-flop 45 is also supplied to UP input terminal, Rst input has precedence over UP input so that the counter 35 is reset in response to the signal supplied from AND gate 23 to Rst input terminal.

On the contrary, where it is not desired to repeat the buttonhole stitching operation for the same buttonhole and otherwise to produce buttonhole stitches for a different buttonhole, the presser bar 1 (FIGS. 4 and 5) is raised to release the contact under pressure between the workpiece and presser 6. Consequently, slider 7 is relatively moved to the left as viewed in FIG. 3 by means of spring 9 so that the contact face 4*a* is again returned to the starting position where it is mounted on the first tapered face 10. The switch lever 4 is therefore shifted to the inoperative position to generate a high-level signal, which is inverted by the invertor 21*a* to output a one-shot low-level signal. Since the sewing machine is not in operation at this time, the discriminator 28 will continuously output a stop (ST) signal to a high-active input terminal of AND gate 24, from which a high-level signal is outputted to one of high-active input terminals of AND gate 25. The other input terminal of AND gate 25 receives FIN signal from the flip-flop 45. Thus, a safety device 36 is set to thereby output an ON signal, in response to which the controller CONT is forced to stop at a step 38. Whilst ON signal is being outputted from the safety device 36, an indication that the safety device 36 is at work will appear at a display 39. At the same time, AND gate 23 is operated in response to the one-shot low-level signal from the step-up device 21 and FIN signal from the flip-flop 45 to output a reset signal, whereupon the counter 35 is reset, but no further stitching operation will proceed as the controller CONT is still made inoperative.

The workpiece is shifted to a position ready to start the buttonhole stitching operation for a different buttonhole, and the presser bar 1 is then lowered. Then a safety device release key $SW_2$ is depressed to generate a low-level signal, which will be supplied to a low-active input terminal of AND gate 26. The other, high-active terminal of AND gate 26 continuously receives ON signal from the safety device 36. Thus, the safety device 36 is now reset to thereby output an OFF signal, instead of an ON signal. The controller CONT will be restored to become operative and the indication of the safety device being at work will now disappear. The counter 35 which receives OFF signal is now reset to start the buttonhole stitching operation as from the first step A of FIG. 7(*a*). OFF signal is also inputted to Rst terminal of the flip-flop 45 which will thus be reset.

The respective stitch control data for the buttonhole stitches also include photo-sensor control data for controlling operation of photo-sensor 14 of presser foot 20. More particularly, the first stitch data for the part A includes photo-sensor control data which commands that photo-sensor 14 remain inoperative regardless of its position, at least during the bar tacks or darning stitch portion (at points $a_1$ to $a_{12}$) and be made operative after several stitches of the line tacks have been produced. In this embodiment shown, such photo-sensor control data are included in stitch control data stored for stitches $a_1$ to $a_{15}$, and after stitching at point $a_{15}$ photo-sensor operation is restored. When the needle reaches the point Na, photo-sensor 14, thus having been made operative, detects that contact face 4*a* of switch lever 4 comes into engagement with second tapered face 13, meaning that gloss reflector 4*b* is in its inoperative position where receiving element 14*b* receives no reflection. The photo-sensor 14 will then generate a high-level signal to the step-up device 21, to thereby proceed to the second step B. The second stitch data for the second part B include photo-sensor control data for nullifying photo-sensor 14 which are stored with respect to first three stitches at points $b_1$ to $b_3$, and thereafter photo-sensor 14 is again made operative so that photo-sensor 14 will become ready for detecting the longitudinal end of the buttonhole at point Nb. At point Nb, contact face 4*a* is driven ashore first tapered face 10. At this time, a high-level signal is generated from photo-sensor 14 so that the pattern number is now stepped up to the third pattern number for the second series of line tacks C. The photo-sensor control data included in the third stitch data is similar to that in the second stitch data, whereupon photo-sensor 14 is annulled during first three stitches at points $c_1$ to $c_3$. The line tacks of of the part C ends at point Nc, which can be detected by photo-sensor 14 due to engagement between face 4*a* and second tapered face 13, resulting in that the fourth pattern number is read out for producing the part D. Stitch control data for the part D include photo-sensor control data upon which photo-sensor 14 remains inoperative during the entire stitching operation for the part D. Stitch control data for the part E, read out designating the fifth pattern number, include photo-sensor control data for nullifying operation thereof during first three stitches at points $e_1$ to $e_3$. Photo-sensor 14 is restored after the three stitches and therefore can detect the final point Ne.

The parts A and D include bar tacks or the like portion stitched with substantially no feed of workpiece or a minimum feed. During such darning stitches, contact face 4*a* may be reciprocally pivotted due to intermittent engagement with first or second tapered face 10 or 13. According to the embodiment, since photo-sensor operation is forced to become invalid so as not to generate a high-level signal during the darning stitches, there is no likelihood that the counter 35 may errouneously be operated in response to the high-level signal from photo-sensor 14 to command that the stitching operation proceed to the next pattern number.

According to the embodiment shown, photo-sensor operation is nullified during the bar tacks by means of control data to the effect included in the respective stitch control data. Any other suitable means for controlling photo-sensor operation can be adopted. For example, the step-up device 21 may be so arranged that a delay circuit is connected between the invertor 21*a* and one-shot multivibrator 21*b*. The delay circuit will allow a signal supplied from the invertor 21*a* over a predetermined period to send to the one-shot multivibrator 21*b*, but prevent signal transmission in case of an intermittent high/low signal change which may arise during stitching of the bar tacks.

The presser foot 20 according to the embodiment shown has a photo-sensor of the reflection type. A photo-sensor of another type is also available. FIGS. 9 and 10 illustrate a modified presser foot 50 utilizing a photo-sensor 57 of permeation type. The photo-sensor 57 consists of a light emitting diode 57*a* and a receiving element 57*b* adapted to receive light emitted from diode 57*a*. The rear end of switch lever 4 is secured to a pivot 59 to which a screen 58 with a penetrating pinhole 58*a* is pivotally connected. Pinhole 58*a* is adapted to allow the light to pass therethrough toward receiving element 57*b*, when the other extreme end 4*a* is not in contact with the first or second tapered face 10 or 13. At this time, photo-sensor 57 generates a low-level signal. On the other hand, when switch lever 4 is in its inoperative position shown by an imaginary line in FIG. 9 due to engagement between the end 4*a* and tapered face 10 or 13, pinhole 58*a* is positioned not in alignment with the light emitting line to disturb the light, whereby a high-level signal is generated from photo-sensor 57.

Although the invention has been described in conjunction with specific embodiments thereof, it is to be understood that many variations and modifications thereof may be made without departing from the spirit and scope of the appended claims.

What is claimed is:

1. An electronic sewing machine comprising a controller for energizing the sewing machine;

memory means for storing stitch control data for a plurality of stitch patterns including a buttonhole stitch pattern, each stitch pattern being assigned one or more pattern numbers;

stitch pattern select means for selecting a specific one of the stitch patterns, thereby generating corresponding pattern number or numbers;

pattern producing means for producing a selected stitch pattern in response to the stitch control data stored in said memory means for the corresponding pattern number or numbers;

and buttonhole sensor means for detecting longitudinal ends of a buttonhole to output a first signal when the buttonhole stitch pattern is being produced by said pattern producing means;

the improvement which further comprises a counter operated in response to said first signal to output a step-up signal;

pattern number renewing means operated in response to said step-up signal to set the pattern number to the next of the selected stitch patterns;

buttonhole stitch-over detecting means for stopping sewing machine operation and at the same time outputting a second signal when the buttonhole stitches have been completed;

discriminating means for outputting a third signal when discriminating the sewing machine is not in operation;

a safety means for setting the sewing machine to a safety condition in which the sewing machine operation is interrupted during receiving said first, second and third signals;

and cancel means for cancelling said safety condition of the sewing machine.

2. The sewing machine according to claim 1 wherein said counter is reset to output a reset signal to said pattern number renewing means, when receiving said first and third signal and when said second signal is not outputted, said pattern number renewing means being in response to said reset signal to reset the pattern number to the first one of the selected stitch pattern.

3. The sewing machine according to claim 1 wherein said buttonhole sensor means comprises a presser foot including a presser bar mounted to a machine housing; a workpiece presser for exerting a downwardly directing pressure onto a workpiece to be stitched and adapted to be moved together with the workpiece; first and second engaging members located in opposition to each other on said workpiece presser, a distance between said first and second engaging members being adjustable in correspondence to a button size; a switch lever having a portion engageable with said first and second engaging members, said switch lever being adapted to be positioned in a first position in which said portion is located between said first and second engaging members with no contact thereto and a second position in which said portion is in engagement with either one of said first and second engaging members; and a sensor means for detecting said switch lever being in the second position, thereby detecting a longitudinal end of the buttonhole.

4. The sewing machine according to claim 3 wherein said switch lever is shifted to the second position when said presser bar is released.

5. An electronic sewing machine comprising memory means for storing stitch control data for a plurality of stitch patterns including a buttonhole stitch pattern, the stitch control data for the buttonhole stitch pattern including a number of different pattern data to be sequentially read out; stitch pattern select means for selecting a specific one of the stitch patterns; first control means operated in response to the stitch control data stored in said memory means of a stitch pattern selected by said stitch pattern select means to produce stitches of the selected stitch pattern; sensor means for detecting longitudinal ends of the buttonhole, said first control means being operated to set the present pattern data to the next one when said sensor means detects one of the longitudinal ends of the buttonhole; and second control means for nullifying operation of said sensor means within bar tack stitch areas produced near the longitudinal ends of the buttonhole.

6. The sewing machine according to claim 5 wherein said second control means is operated by control data stored in said memory means together with the stitch control data for the buttonhole stitches.

7. The sewing machine according to claim 5 wherein said second control means comprises an electronic control circuit for nullifying intermittent on/off signals generated from said second control means.

8. A process for producing buttonhole stitches with an electronic sewing machine wherein plural series of stitch control data for the buttonhole stitches are sequentially read out from a memory unit to control a needle amplitude and a fabric feeding amount, one series of the stitch control data being set to the next series when a longitudinal end of the buttonhole is detected with sensor means, the improvement in which operation of said sensor means is annulled during stitching of portions of bar tacks produced at both longitudinal ends of the buttonhole.

9. A buttonhole presser foot used in combination with a zigzag sewing having a needle which is vertically reciprocable and laterally swingable, a presser bar mounted substantially in parallel with said needle and fabric feeding means for feeding a fabric placed on a machine bed in predetermined direction, said buttonhole presser foot comprising:

a photo-impermeable supporting frame mounted detachably to the lower end of said presser bar;

a sliding member pivotably connected to the lower end of said supporting frame and including a needle penetrating hole;

a presser foot sole mounted slidably with respect to said sliding member and adapted to exert a downward pressure onto the fabric and cooperating with said fabric feeding means to feed the fabric;

a first engaging member secured to said presser foot sole;

a second engaging member attached to said presser foot sole, said second engaging member being slideable with respect to said presser foot sole so that a distance between said first and second engaging members is adjustable in accordance with a length of a buttonhole to be formed;

a switch lever pivotted to said supporting frame and having a first end engageable with either one of said first and second engaging members when the stitching operation reaches one longitudinal end of the buttonhole and a second end substantially encircled within said supporting frame;

photo-sensor means for detecting displacement of said second end of said switch lever activated when said first end comes into engagement with either one of said first and second engaging members.

10. The buttonhole presser foot according to claim 9 wherein said second end of said switch lever provides a light reflector and said photo-sensor means comprises a photo-impermeable casing secured to said supporting frame in a close vicinity thereto and light emitting means and light receiving means secured to said casing, said second end being positioned to reflect the light emitted from said light emitting means towards said light receiving means while producing the buttonhole, said position of said second end being displaced to interrupt the light reflection when said second end is displaced.

11. The buttonhole presser foot according to claim 9 wherein said second end of said switch lever provides a light path and said photo-sensor means comprises light emitting means and light receiving means secured within said supporting frame and opposed to each other with said second end put therebetween, said second end being positioned to pass the light emitted from said light emitting means through said light path towards said light receiving means while producing the buttonhole, said position of said second end being displaced to interrupt the light passage when said second end is displaced.

* * * * *

UNITED STATES PATENT AND TRADEMARK OFFICE
CERTIFICATE OF CORRECTION

PATENT NO. : 4,878,444

DATED : November 7, 1989

INVENTOR(S) : Yasuro Sano, et al

It is certified that error appears in the above-identified patent and that said Letters Patent is hereby corrected as shown below:

The sheets of Drawing consisting of Figs. 1-10 should be added as per attached sheets.

Signed and Sealed this

Eighteenth Day of June, 1991

*Attest:*

HARRY F. MANBECK, JR.

*Attesting Officer*

*Commissioner of Patents and Trademarks*